US007093782B2

(12) United States Patent
Artru et al.

(10) Patent No.: US 7,093,782 B2
(45) Date of Patent: Aug. 22, 2006

(54) METHOD AND DEVICE FOR FINE GRINDING OF MINERAL PARTICLES

(75) Inventors: Philippe Artru, Meylan (FR); Merien Ould Rouis, Grenoble (FR); Edouard Landao, Orvault (FR)

(73) Assignee: Wheelabrator-Allevard, Le Cheylas (FR)

( * ) Notice: Subject to any disclaimer, the term of this patent is extended or adjusted under 35 U.S.C. 154(b) by 202 days.

(21) Appl. No.: 10/480,815

(22) PCT Filed: Jun. 25, 2002

(86) PCT No.: PCT/FR02/02197
§ 371 (c)(1),
(2), (4) Date: Jan. 29, 2004

(87) PCT Pub. No.: WO03/000427

PCT Pub. Date: Jan. 3, 2003

(65) Prior Publication Data

US 2004/0118954 A1 Jun. 24, 2004

(30) Foreign Application Priority Data

Jun. 25, 2001 (FR) ..... 01 08350

(51) Int. Cl.
*B02B 5/02* (2006.01)
*B02C 25/00* (2006.01)
*B02C 17/14* (2006.01)

(52) U.S. Cl. ..... 241/29; 30/184

(58) Field of Classification Search ..... 241/29, 241/30, 184, 170
See application file for complete search history.

(56) References Cited

U.S. PATENT DOCUMENTS

| | | | | |
|---|---|---|---|---|
| 1,720,024 | A * | 7/1929 | Young | 241/184 |
| 1,860,393 | A * | 5/1932 | Newhouse | 241/184 |
| 2,021,671 | A * | 11/1935 | Skinner | 423/157.3 |
| 2,332,701 | A * | 10/1943 | Dowsett | 241/29 |
| 3,027,105 | A * | 3/1962 | Hall | 241/184 |
| 3,028,104 | A * | 4/1962 | Hall | 241/176 |
| 3,904,130 | A * | 9/1975 | Delfosse et al. | 241/30 |
| 6,070,817 | A * | 6/2000 | Yanase | 241/171 |

FOREIGN PATENT DOCUMENTS

| | | |
|---|---|---|
| DE | 339733 | 8/1921 |
| DE | 94 10 261.9 | 12/1994 |
| FR | 2.228.115 | 11/1974 |
| GB | 1 209 194 | 10/1970 |
| WO | WO 00/43555 | 7/2000 |

OTHER PUBLICATIONS

Prof. Dr. Ing. E. Forssberg et al., "Dry, Fine Grinding of Dolomite with the Sala Agitated Mill SAM 7.5—Effects of Grinding Media and Grinding Additive", Aufbereitungs-Technik 36, No. 5, pp. 211-217, 1995.

* cited by examiner

*Primary Examiner*—Faye Francis
(74) *Attorney, Agent, or Firm*—Oliff & Berridge, PLC.

(57) ABSTRACT

A method for fine grinding of mineral particles consists of producing by atomization pellets, made from steel with a high carbon content, or cast iron, with a granular size range less than 15 mm and mixing the pellets with balls, made from steel or cast iron with dimensions between 20 mm and 120 mm, in a rotating grinding mill, the proportion by weight of pellets depending on the granular size of the mineral particles for grinding and the desired reduction ratio.

11 Claims, 3 Drawing Sheets

METHOD AND DEVICE FOR FINE GRINDING OF MINERAL PARTICLES

BACKGROUND OF THE INVENTION

The invention relates to a fine grinding method of mineral particles by means of a grinding mill containing grinding bodies comprising steel or cast iron balls having dimensions comprised between 20 mm and 120 mm.

STATE OF THE ART

It is state of the art to use grinding balls in horizontal rotary grinding mills to reduce the granulometry of previously crushed mineral particles. The sizes of these balls when new are seldom smaller than 22.5 mm. The mechanical strength of these balls of large sizes nevertheless remains limited due to the unequal radial distribution of the hardness and of the metallic structure obtained when thermal processing is performed. The hardness is often lower in the centre which results in premature and irregular wear of the balls. Another drawback is the large amount of energy required by the grinding mill to obtain a predetermined granulometry on output, all the more so the finer this granulometry.

It has in fact already been proved and described in numerous publications that the finer the granulometry of the input product, the better it is to reduce the size of the balls to obtain a given grinding efficiency with the minimum energy expenditure. The determining factor then becomes the surface of the grinding media which increases as their sizes decrease.

In a rotary grinding mill, the essential part of the variable energy is that which is required to set the charge of the grinding bodies in motion, whereas the energy for driving the grinding mill itself in rotation is predetermined. If the charge of the grinding bodies is reduced, the necessary energy (at equal productivity) will be reduced. This reduction of the charge is possible with a grinding medium of small size, which makes for a more efficient grinding, all other things being equal.

OBJECT OF THE INVENTION

The object of the invention is to provide a fine grinding method of mineral particles enabling an optimum efficiency of the grinding mill to be obtained with a saving in energy and an increase in productivity.

The method according to the invention is characterized by the following steps consisting in:

- manufacturing by atomization of steel pellets with a high carbon content or of cast iron pellets in a granulometry range remaining lower than 15 mm,
- and mixing the pellets with the balls inside the grinding mill in a preset weight proportion depending on the granulometry of the mineral particles to be ground and on the reduction ratio required between the input feed and the final product.

According to one feature of the invention, the weight proportion of the pellets in the mixture increases if the granulometry of the particles on input is decreased, and inversely decreases in case of an increase of said granulometry.

The steel or the cast iron of the pellets have a carbon content of about 0.6% to 3.5% and can be alloyed with Cr and/or Mo.

According to another feature of the invention, the pellets after atomization undergo a thermal treatment for core hardening designed to increase the mechanical strength and corrosion resistance.

BRIEF DESCRIPTION OF THE DRAWINGS

Other advantages and features will become more clearly apparent from the following description of an embodiment of the invention, given as a non-restrictive example only and represented in the accompanying drawings, in which.

DESCRIPTION OF A PREFERRED EMBODIMENT

Figure 1:
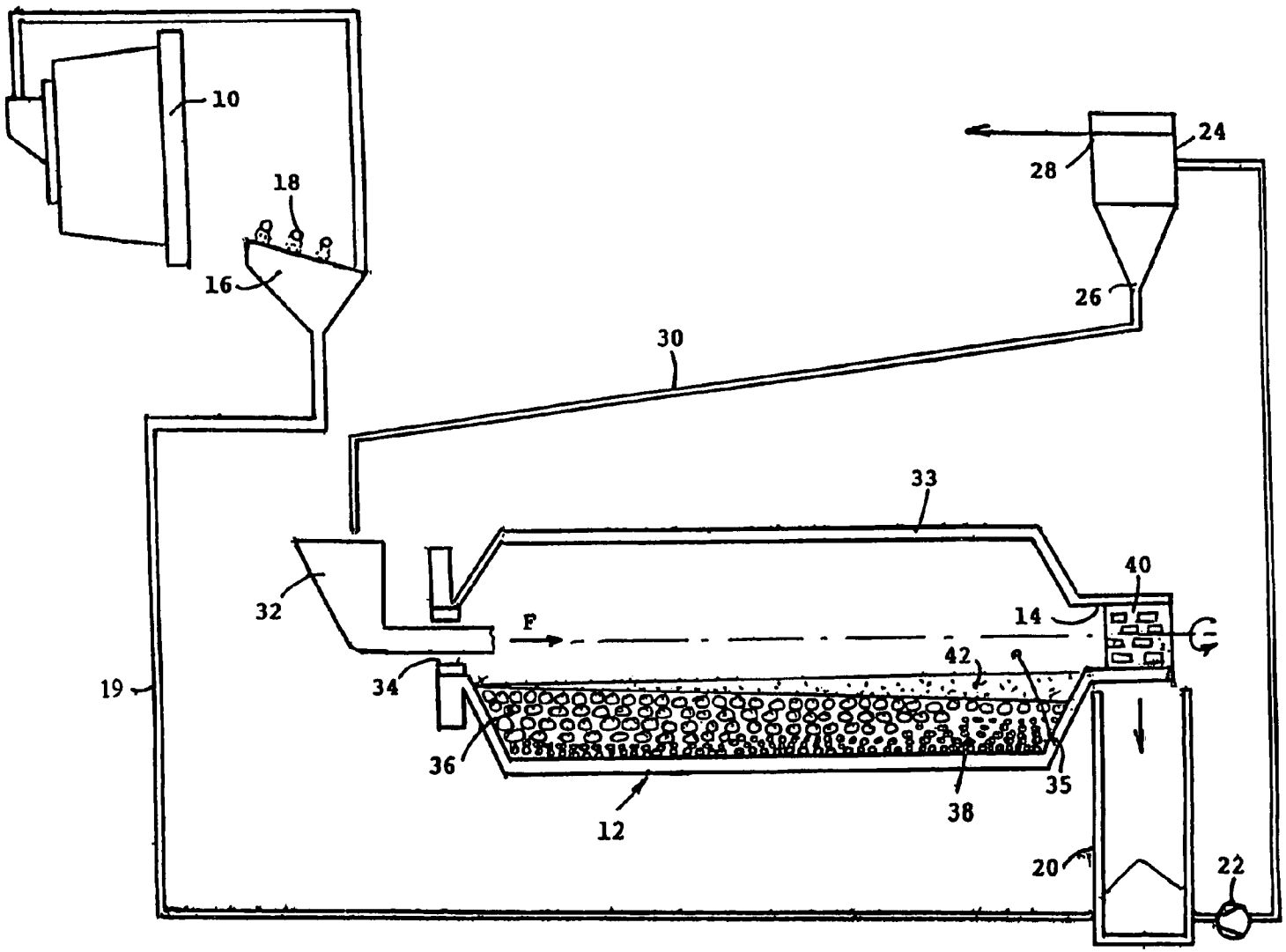
FIG. 1 is a schematic view of the grinding circuit equipped with a primary grinding mill upstream from a secondary grinding mill for fine grinding of the particles.

The invention relates to fine grinding of mineral particles, in particular rocks, ore, sulphide concentrate or other minerals with a high metal content, or industrial minerals having previously undergone a first size reduction in a primary grinding mill 10. The dimensions of the mineral particles obtained following this preliminary grinding are generally larger than 50 or 100 microns. Subsequent fine grinding is then performed in a secondary rotary recirculating grinding mill 12 (closed circuit) to reduce the granulometry of the particles on outlet 14. It is also possible to use a grinding mill without recirculation (open circuit not shown in FIG. 1).

The primary grinding mill 10 of autogenous type is associated to a screen 16 whereon a spraying line 18 is mounted to separate the solid fragments of rock according to their size. The largest fragments are recycled in the primary grinding mill 10 and the finest fragments are sent to the secondary grinding circuit. The base of the screen 16 is connected by a duct 19 to a recovery tank 20 connected via a pump 22 to at least one cyclone separating device 24.

The cyclone 24 comprises a recycling underflow 26 and an evacuation overflow 28 for the finished product corresponding to fine grinding presenting a granulometry of less than 100 microns. A pipe 30 connects the underflow 26 to a feed hopper 32 of the secondary grinding mill 12 to perform recycling of the too large particles.

The secondary grinding mill 12 with horizontal rotary drum 33 comprises an inlet 34 connected with the hopper 32 and a longitudinal chamber 35 containing grinding bodies or media formed by a mixture of steel balls 36 and pellets 38. The outlet 14 of the secondary grinding mill 12 is offset downwards with respect to the level of the inlet 34 and comprises a grate 40 arranged above the recovery tank 20.

Inside the drum 33, the balls 36 and pellets 38 are distributed over the whole length of the chamber 35 remaining stocked by gravity at a filling level that is set back with respect to the inlet 34 and outlet 14, said level depending on the filling coefficient of the charge. The particles to be ground are injected into the chamber 35 in the axial direction indicated by the arrow F.

The balls 36 of the grinding charge are used in conventional manner in the grinding mills and are generally made of steel or cast iron with sizes comprised between 20 mm and 120 mm. The shape of the balls 36 can be spherical or cylindrical with precise diameters.

The grinding system in liquid phase described above can also be replaced by dry grinding in open circuit or closed circuit with recirculation. In this case, the fluid is air. Such a device is particularly suitable for grinding cement.

The innovation consists in mixing the pellets 38 of smaller sizes with the balls 36 to optimize the reduction ratio of the particles inside the secondary grinding mill 12.

The pellets 38 present spherical or slightly flattened shapes with diameters smaller than 15 mm. The chemical composition of the pellets 38 can be that of steel or cast iron shot with a carbon content of about 0.6% to 3.5%. The steel or cast iron can be alloyed with Cr and/or Mo, or any other element liable to increase the resistance to wear, corrosion and shocks occurring when grinding takes place.

The steel or cast iron pellets 38 are advantageously obtained by water atomization or by centrifugation, with a variable granulometry range remaining less than 15 mm. After the atomization phase, the pellets 38 undergo shape selection, sorting by size, and then thermal treatments to perform core hardenings designed to render the hardness at the periphery and in the centre uniform.

In the atomization phase, the minimum cooling rate in the mass of a pellet 38 is preferably greater than 10° C./second.

The weight proportion of the pellets 38 in the mixture with the balls 36 depends on the granulometry of the particles at the inlet 34 of the secondary grinding mill 12. It will be greater the finer the granulometry of the input particles. Inversely, if the granulometry of the particles of the product to be ground is increased, the proportion of pellets 38 has to be reduced compared with the proportion of balls 36. When rotation of the grinding drum 33 takes place, the pellets 38 attack the small particles whereas the balls 36 take care of the larger particles. The grindability of the product to be ground can also influence the proportion of pellets 38.

The pellets 38 and balls 36 of the grinding bodies have an absolute density greater than 7.5. The smallest pellets 38 will occupy the gaps between the balls 36 so as to increase the apparent density of the charge and release volume for the pulp 42. The apparent density of the pellets 38 must be greater than 4. The diameter of the spherical pellets is preferably comprised between 1 mm and 12 mm.

When grinding takes place, the layer of pulp 42 is higher than the level of the grinding charge, at a level substantially coplanar with the outlet 14 and below the inlet 34.

Figure 2:
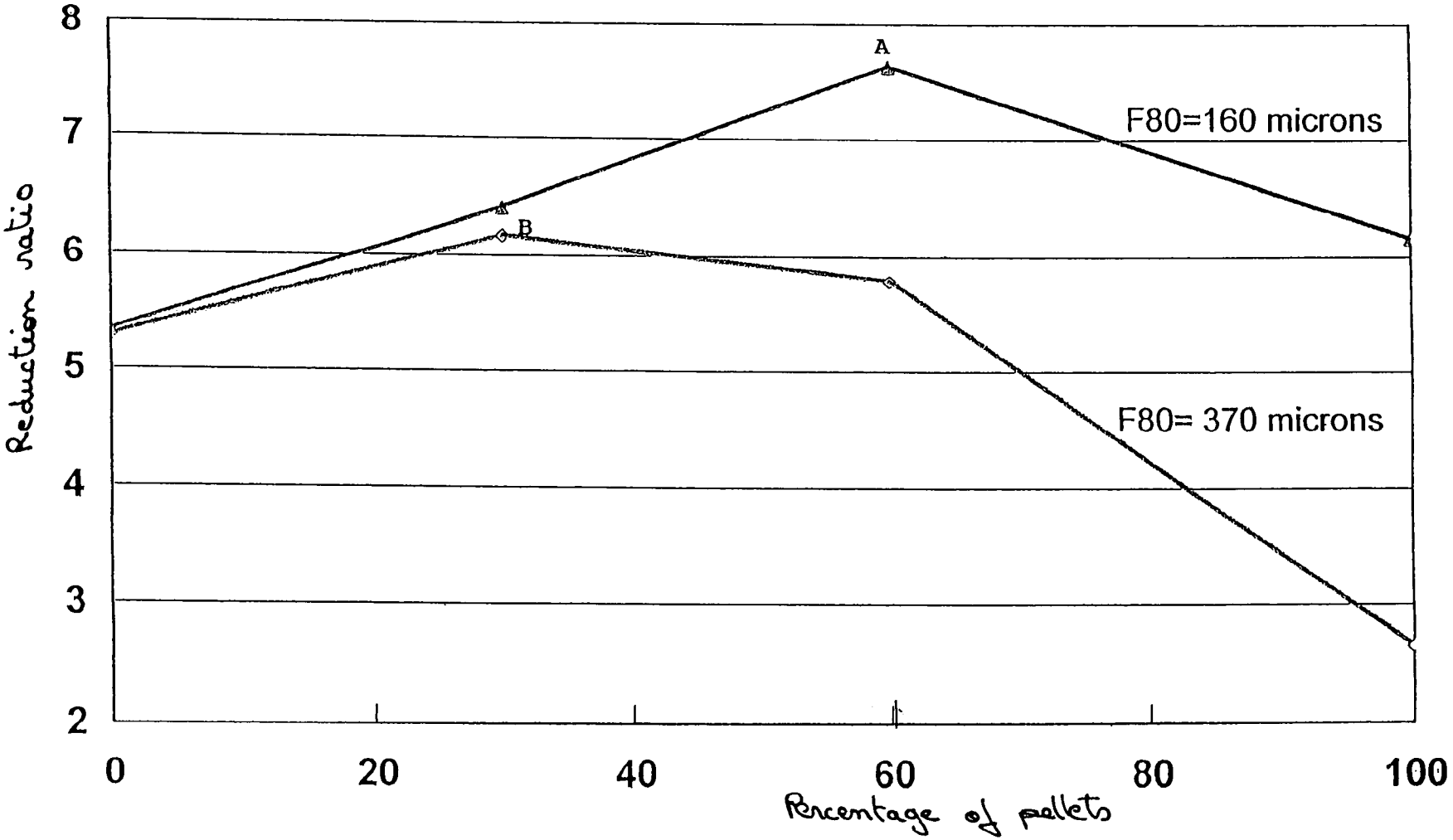
FIG. 2 illustrates two diagrams of the reduction ratio of the particles of the product to be ground according to the weight proportion of the pellets in the grinding mixture.

FIG. 2 shows two diagrams of the reduction ratio of the particles of the product to be ground versus the weight proportion of the pellets 38 in the grinding mixture corresponding to two granulometries of 160 microns and 370 microns of the particles, and to a same grinding time of about 30 minutes.

For the curve F80 of 160 micron granulometry, the reduction ratio of the particles is optimum (about 7.5) when the percentage of pellets 38 in the mixture is about 60%. The reduction ratio increases linearly by 40% (from 5.3 to 7.5) for a percentage of pellets 38 varying from 0 to 60%.

For the curve F80 of 370 micron granulometry, the reduction ratio of the particles is optimum (about 6.2) when the percentage of pellets 38 in the mixture is about 30%. It then decreases with a very slight downward slope (down to 5.8) when the percentage of pellets 38 varies from 30% to 60%. The reduction ratio increases linearly by 16% (from 5.3 to 6.2) for a percentage of pellets 38 varying from 0 to 30%.

The peaks A and B of the two curves correspond to the maximum degree of grinding of the grinding mill for predetermined granulometries on input. The optimum final granulometry on output of the secondary grinding mill 12 is then about 20 microns following the reduction ratio of 7.5 for an input granulometry of 160 microns and 60 microns following the reduction ratio of 6.2 for an input granulometry of 370 microns.

It is naturally possible to choose the percentage of pellets 38 from 10% to 80% according to the final granulometry required.

Figure 3:
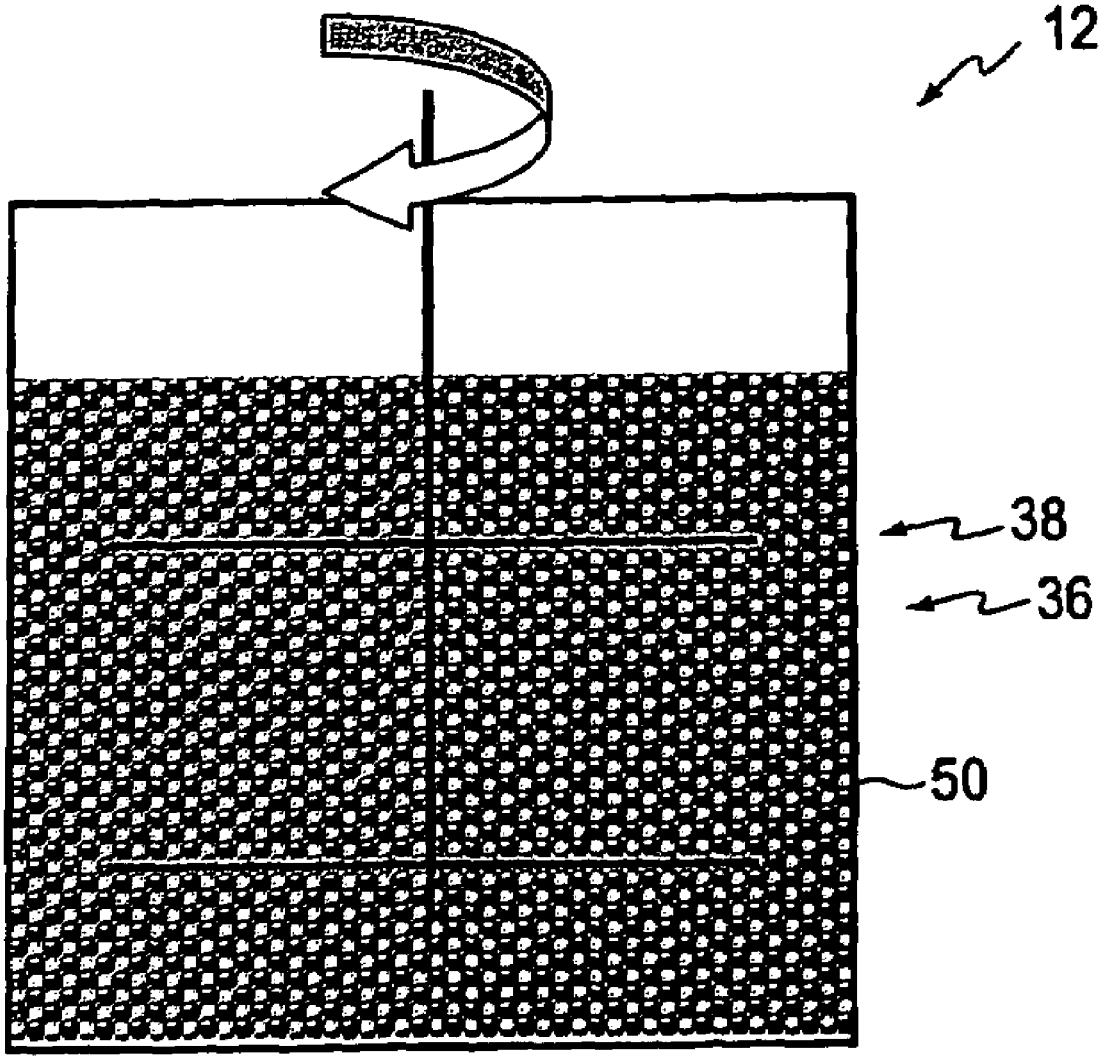
FIG. 3 is an exemplary view of a secondary grinding mill shown as a vertical grinding mill.

The advantages resulting therefrom for the same product to be ground (nature and granulometry) at the input of the grinding mill 12 are the following:

- energy saving of about 10% to 20% for a horizontal rotary grinding mill and from 30% to 300% for a Vertimill type vertical rotary grinding mill, for example grinding mill 50 as shown in FIG. 3, at equal flow of solid material passing through the grinding mill;
- productivity increase of up to 30% at equal energy and equal fineness of the ground product on output;
- improvement of the fineness of the ground product at equal energy and equal flow rate.

When rotation of the horizontal grinding mill 12 of FIG. 1 takes place, it has been noted that the pellets 38 do not escape through the grate 40 and remain stocked by gravity inside the chamber 35 placing themselves under the balls 36 so as to form a bottom layer of progressive thickness along the longitudinal direction. In the course of grinding, most of the pellets 38 accumulate on the side where the outlet 14 is located without exceeding the level of the layer of pulp 42. The pellets 38 do however remain protected by a layer of balls 36.

The invention claimed is:

1. Fine grinding method of mineral particles by means of a rotary grinding mill containing grinding bodies comprising steel or cast iron balls having dimensions between 20 mm and 120 mm, wherein the method comprises:

providing atomized steel pellets with a high carbon content or of cast iron pellets in a granulometry range remaining lower than 15 mm; and mixing the pellets with the balls inside the grinding mill in a preset weight proportion depending on the granulometry of the mineral particles to be ground and on a reduction ratio required between an input feed and a final product and fine grinding the mineral particles.

2. Fine grinding method according to claim 1, wherein the weight proportion of the pellets in the mixture increases if the granulometry of particles on input is decreased, and inversely decreases in case of an increase of said granulometry.

3. Fine grinding method according to claim 1, wherein the carbon content of the steel or cast iron pellets is about 0.6% to 3.5%.

4. Fine grinding method according to claim 3, wherein the steel or the cast iron of the pellets can be alloyed with Cr and/or Mo.

5. Fine grinding method according to claim 3, wherein the pellets after atomization undergo a thermal treatment for core hardening.

6. Fine grinding method according to claim 1, wherein the pellets are spherical pellets having a diameter between 1 mm and 12 mm.

7. Fine grinding method according to claim 1, wherein the mineral particles to be ground are presented at an inlet of a secondary grinding mill at a granulometry greater than 50 microns which is obtained after a first size reduction in a primary grinding mill.

8. Fine grinding method according to claim 1, wherein grinding takes place in a horizontal or vertical grinding mill.

9. Fine grinding method according to claim 1, wherein the pellets and the balls of the grinding bodies have an absolute density greater than 7.5.

10. Fine grinding method according to claim 1, wherein an apparent density of the pellets must be greater than 4.

11. Fine grinding method according to claim 1, wherein, during the atomization phase of the pellets, a minimum cooling rate in a mass of the pellet is greater than 10° C./second.

* * * * *